US006279281B1

(12) United States Patent
Lee

(10) Patent No.: US 6,279,281 B1
(45) Date of Patent: Aug. 28, 2001

(54) CONCRETE FORMING SYSTEM

(76) Inventor: Ho San Lee, 22-403 Jukong-Apt. 938 Wongok-dong, Ansan, Kyonggi-do (KR)

( * ) Notice: Subject to any disclaimer, the term of this patent is extended or adjusted under 35 U.S.C. 154(b) by 0 days.

(21) Appl. No.: 09/443,928

(22) Filed: Nov. 19, 1999

(30) Foreign Application Priority Data

Nov. 20, 1998 (KR) ..... 98-49915

(51) Int. Cl.[7] ..... E04B 5/16

(52) U.S. Cl. ..... 52/335; 52/414; 249/13; 249/18; 249/21

(58) Field of Search ..... 52/335, 336, 414; 249/13, 18, 21

(56) References Cited

U.S. PATENT DOCUMENTS 1,786,751 * 12/1930 Heeren ..... 52/335
4,151,694 * 5/1979 Sriberg et al. ..... 52/335 X
4,335,557 * 6/1982 Morton ..... 52/336 X
5,906,076 * 5/1999 McManus ..... 52/414 X

* cited by examiner

*Primary Examiner*—Christopher T. Kent
(74) *Attorney, Agent, or Firm*—Lee & Hong

(57) ABSTRACT

Disclosed is a concrete forming system for constructing an upper wall for a bridge or a building, including: a plurality of beams, each having a flange; a plurality of steel bars arranged between the two opposing beams; a plurality of slabs on the steel bars; a plurality of brackets, each having a horizontal portion and a vertical portion, the horizontal portion having a first engaging means, and the vertical portion being welded to an end of the steel bar; and a second engaging means for removably engaging the horizontal portion and the flange of the beam.

13 Claims, 4 Drawing Sheets

CONCRETE FORMING SYSTEM

This application claims the benefit of Korean Patent Application No. 1998-49915, filed on Nov. 20, 1998, which is hereby incorporated by reference.

BACKGROUND OF THE INVENTION

1. Field of the Invention

The present invention relates to a concrete forming system used in a structural steel construction, more particularly to a concrete forming system for bridges or upper walls of buildings.

2. Description of the Related Art

Concrete forming systems are well known and widely used in the concrete structures. Concrete forming system generally comprises a concrete slab or panel, a section steel bar and a beam member, and is frequently used to create a substantially flat concrete surface for a horizontal floor or roof sections and vertical wall sections.

According to conventional art, to build bridges or buildings, a plurality of the concrete slabs or panels which are usually made of wood are used, and on the slabs concrete is formed. But to build a bridge or an upper wall of a building, there are some problems to provide the concrete slabs.

Thus, deck plates are developed instead of concrete slabs. The deck plates are assembled with the H-beam by welding, and on the deck plates concrete is poured and becomes solid.

However, such a concrete forming system has the following disadvantages.

Since the deck plate and the beam are welded, the deck plates can not be reused. In addition, a welding portion between the deck plate and the beam member may be decayed due to salty water or rainwater leading to a structural weakness. Besides, it is impossible to discern a cracked state of the concrete construction with naked eyes in the upper direction, since the lower portion of the upper wall or the bridge is covered with the deck plates. Thus, even when a concrete construction is cracked, it is so difficult to find the cracked state, which leads to lose proper time to repair the concrete construction.

SUMMARY OF THE INVENTION

Accordingly, the present invention is directed to a concrete forming system that substantially obviates some or all of the problems due to the limitations and limitation related to the prior art.

An object of this invention is to provide a reusable concrete forming system.

Another object of the invention is to provide a concrete forming system that is easy to find a defect such as a crack.

Additional features and advantages of the invention will be set forth in the description with follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and the in accordance with the purpose of the present invention, as embodied and broadly described, the present invention provides, in one aspect, a concrete forming system for constructing an upper wall for a bridge or a building, including: a plurality of beams, each having a flange; a plurality of steel bars arranged between the two opposing beams; a plurality of slabs on the steel bars; a plurality of brackets, each having a horizontal portion and a vertical portion, the horizontal portion having a first engaging means, and the vertical portion being welded to an end of the steel bar; and a second engaging means for removably engaging the horizontal portion and the flange of the beam.

The first engaging means is a through hole, the second engaging means has a nut and a bolt which penetrates the through hole, and the flange of the beam is interposed between the nut and the horizontal portion of the bracket.

The concrete forming system further includes a support interposed between the horizontal portion of the bracket and the nut, the support having a substantially same height as that of the flange of the beam.

It is to be understood that both the foregoing general description and the following detailed description are exemplary and are intended to provide further explanation of the invention as claimed.

BRIEF DESCRIPTION OF THE DRAWINGS

The accompanying drawings, which are included to provide a further understand of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Reference will now be made in detail to the preferred embodiments of the present invention, an example of which is illustrated in the accompanying drawings.

Figure 1:
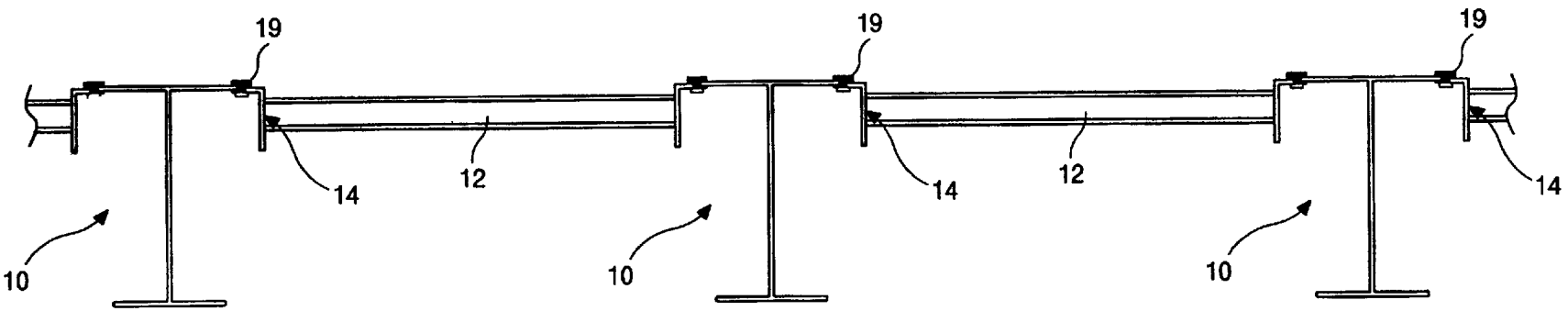
FIG. 1 is a schematic sectional view showing a concrete forming system according to an embodiment of the invention.
Figure 2:
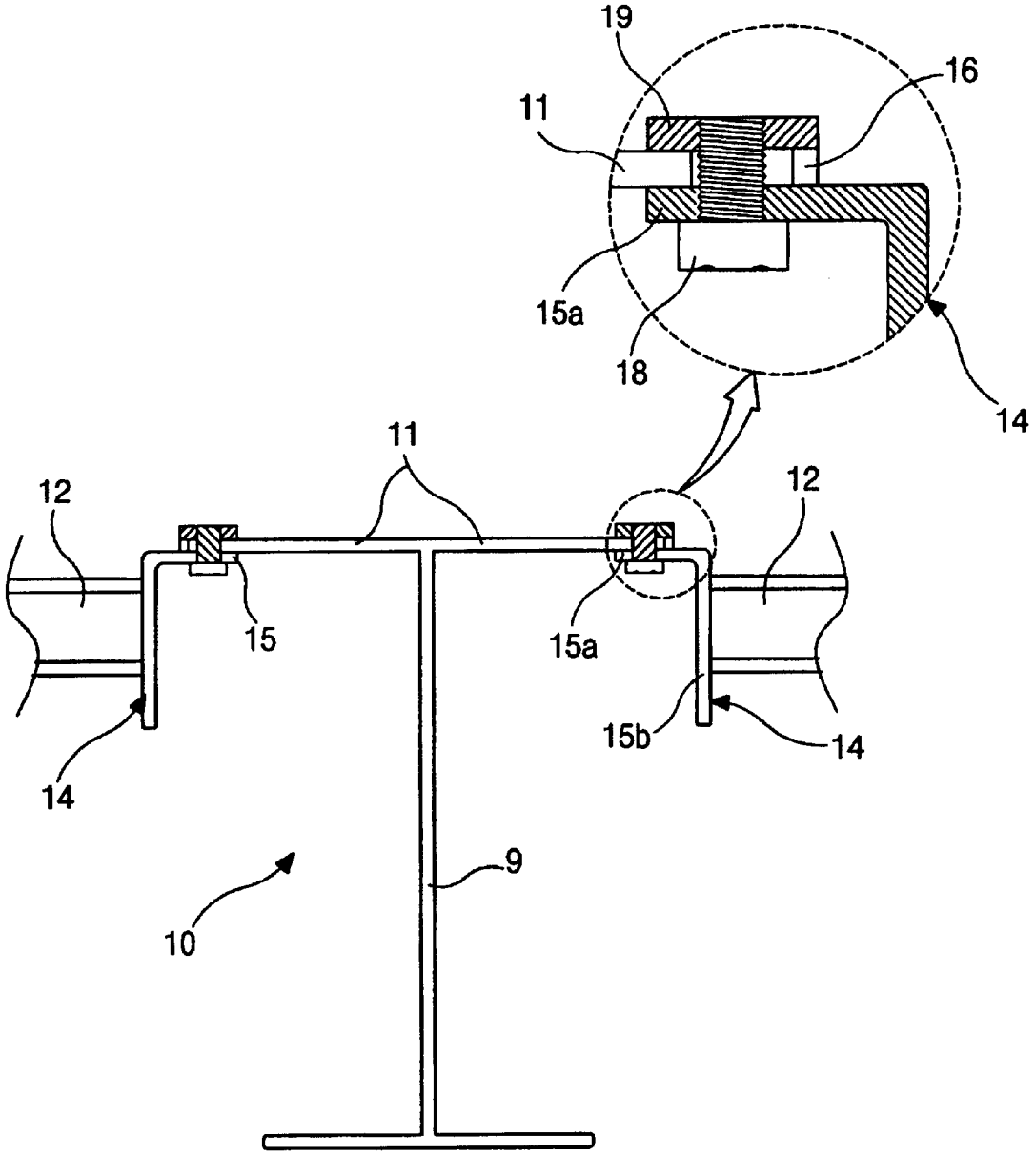
FIG. 2 is an enlarged view showing coupling state of a bracket and an H-beam of FIG. 1.
Figure 3:
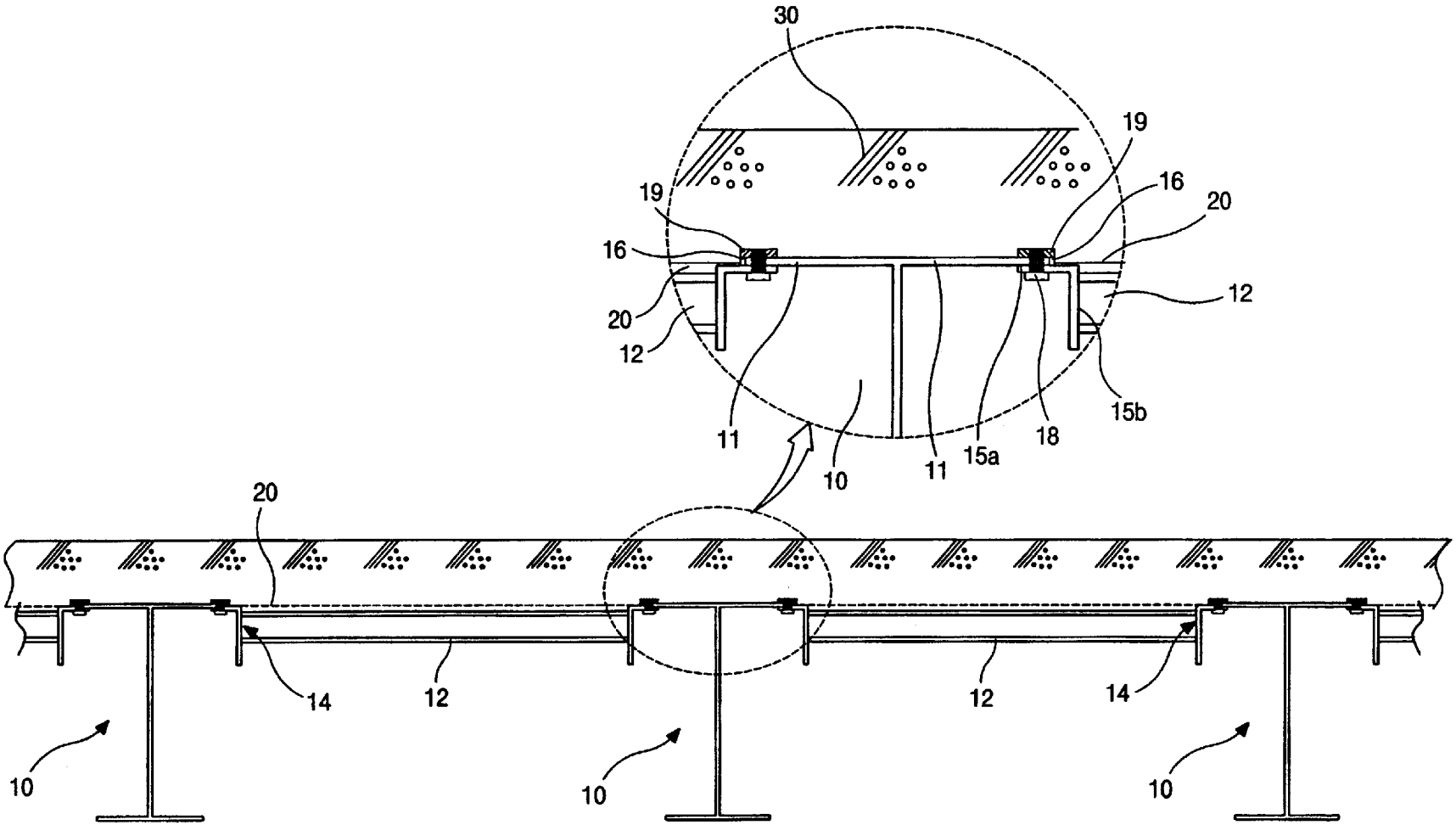
FIG. 3 is a schematic sectional view showing the state that concrete is poured on the concrete forming system of FIG. 1.

As shown in FIGS. 1, 2 and 3, H-beam 10 has two flanges 11 and a web 9 between the flanges 11 and is regularly spaced from each other. "C" shaped section steel bars 12 are arranged between two opposing H-beams 10. A distance between the section steel bars 12 arranged between the two H-beams is about 0.5 to 1 m. The section steel bars 12 are coupled to the H-beams via brackets 14. The bracket 14 has a horizontal portion 15*a* and a vertical portion 15*b*. The horizontal portion 15*a* has a through hole and the vertical portion 15*b* is welded to the section steel bar 12. At least one bolt 18 is tightened with a nut 19 interposing the horizontal portion 15*a* of the bracket 14 and an end portion of the flange 11 of the H-beam 10 from below of the steel bar 12 toward upper direction. At this point, a separate support 16 is preferably interposed to compensate for a height of the flange 11 of the H-beam 10 and it has a substantially same height as that of the flange 11. To cover the support 16 and the end portion of the flange 11 of the H-beam 10, the nut 19 has an enough surface area.

Figure 4:
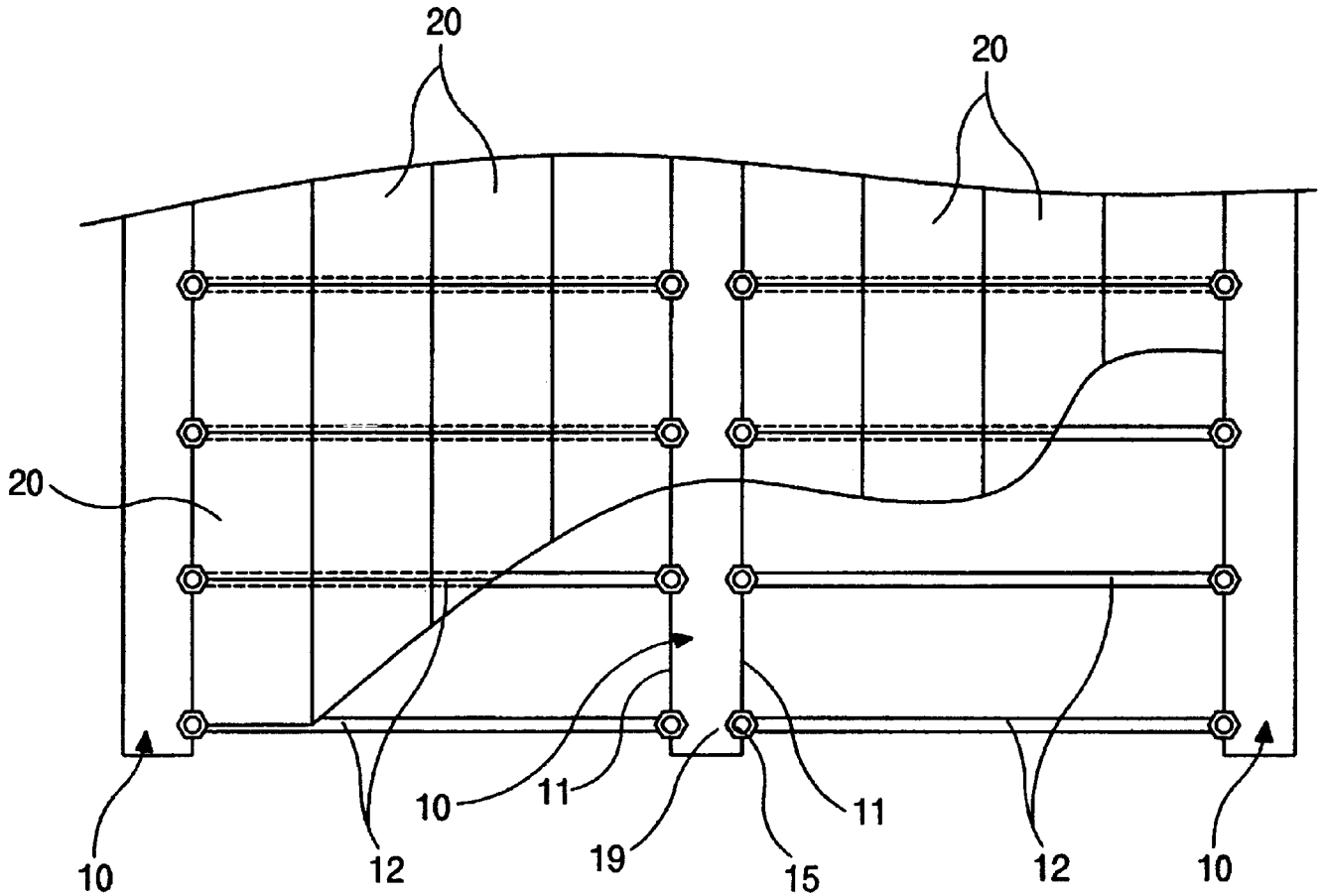
FIG. 4 is a plane view showing the state that a plurality of concrete panels are arranged on the concrete forming system of FIG. 1.

To effect construction, as shown in FIGS. 3 and 4, a plurality of the concrete slabs 20 are uniformly arranged on the sectional bars 12 to form an upper surface of the concrete forming system. A sealant or a taper can seal a gap between the concrete slabs 20. On the slabs 20, iron-reinforcing rods (not shown) are arranged by a desirable manner and the concrete 30 is poured.

When the concrete becomes solid satisfactorily, the section steel bars 12 are dissembled from the H-beam by loosening the bolt 18 and the concrete slabs 20 can also be dissembled from the concrete construction.

The embodiment of the present invention has the following advantages.

Since the concrete slabs and the sectional bars can be removed, they can be reused.

Since there is no welding portion in the concrete forming system, any corrosion can not occur.

Since the lower surface of the concrete construction formed by the system is exposed, the cracked portions of the concrete construction can be easily discerned with naked eyes.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

For examples, the flange of the H-beam can have a through hole corresponding to the through hole of the horizontal portion of the bracket, and the beam and the slab have various shapes.

What is claimed is:

1. A concrete forming system for constructing an upper wall for a bridge or building, comprising:

a plurality of beams, each having an upstanding web and a flange perpendicularly extending from an upper end of the web;

a plurality of steel bars, each steel bar horizontally elongated and arranged between two adjacent beams of the plurality of beams;

a plurality of slabs on one of the steel bars for pouring concrete thereon;

a plurality of brackets, each having a horizontal portion and a vertical portion, the vertical portion being secured to an end of the steel bars, the horizontal portion being placed substantially parallel to the flange of the beams and having a first engaging means; and a second engaging means corresponding to the first engaging means for removably engaging the horizontal portion of the brackets and the flange of the beams, wherein both ends of one of the steel bars are secured by the vertical portion of each of the brackets, and wherein the first and second engaging means are disengaged after the wet concrete is hardened, thereby the slabs and steel bars can be reused.

2. The system of claim 1, wherein the first engaging means includes a through hole penetrating the horizontal portion of the bracket in a vertical direction, the second engaging means includes a bolt inserted from a lower position of the horizontal portion of the bracket and a nut disposed at an upper position of the horizontal portion of the bracket corresponding to the bolt, and between the nut and the horizontal portion the flange of the beams is interposed.

3. The system of claim 2, further comprising a support interposed between the horizontal portion of the bracket and the nut, the support having a substantially same height as that of the flange of the beam.

4. A concrete forming system for receiving concrete thereon, comprising:

a plurality of beams, each beam having a flange;

at least one elongated member arranged between two adjacent beams, the elongated member having a bracket comprising a horizontal portion at each end thereof, wherein each horizontal portion of the elongated member is placed parallel to the flange of the two adjacent beams; and a plurality of fasteners, each fastener securing the each horizontal portion of the elongated member against the corresponding flange of the two adjacent beams, wherein each fastener is installed at a lower surface of the flange and is to be removed after the concrete is poured.

5. The concrete forming system of claim 4, wherein each beam is an H-beam.

6. The concrete forming system of claim 4, wherein the elongated member is a steel bar.

7. The concrete forming system of claim 4, wherein the horizontal portion of the elongated member is disposed under the flange of the beam so as to be removed after the concrete is poured above the beam.

8. The concrete forming system of claim 4, wherein the each fastener comprises a bolt and a nut, the nut being placed above the flange of the beam and the bolt being inserted from below.

9. The concrete forming system of claim 4, further comprising at least one slab being placed on and supported by the elongated member.

10. The concrete forming system of claim 5, wherein the horizontal portion of the elongated member is disposed under the flange of the beam so as to be removed after the concrete is poured above the beam.

11. The concrete forming system of claim 10, wherein the each fastener comprises a bolt and a nut, the nut being placed above the flange of the beam and the bolt being inserted from below.

12. The concrete forming system of claim 11, further comprising a support disposed between the horizontal portion of the elongated member and the nut, the support having a substantially same height as that of the flange of the beam.

13. The concrete forming system of claim 5, further comprising at least one slab being placed on and supported by the elongated member.

* * * * *